US005884434A

United States Patent [19]

Dedrich et al.

[11] Patent Number: 5,884,434

[45] Date of Patent: Mar. 23, 1999

[54] DOOR HANDLE TO LATCH ROD CONNECTION

[75] Inventors: Paul Martin Dedrich; Douglas Alan Ford, both of Grand Blanc; Paul A. Habel, Oakland Township, all of Mich.

[73] Assignee: General Motors Corporation, Detroit, Mich.

[21] Appl. No.: 97,059

[22] Filed: Jun. 12, 1998

[51] Int. Cl.[6] ..... E06B 3/00

[52] U.S. Cl. ..... 49/503; 49/502; 296/146.7

[58] Field of Search ..... 49/502, 503, 460; 296/146.1, 146.7, 146.4

[56] References Cited

U.S. PATENT DOCUMENTS

| | | | |
|---|---|---|---|
| 3,596,955 | 8/1971 | Colell | 292/165 |
| 3,679,251 | 7/1972 | Brockman et al. | 292/216 |
| 3,784,242 | 1/1974 | Hill | 292/336.3 |
| 4,343,501 | 8/1982 | Meeks | 292/336.3 |
| 5,040,335 | 8/1991 | Grimes | 49/502 |
| 5,095,659 | 3/1992 | Benoit et al. | 49/503 |
| 5,263,750 | 11/1993 | Smith et al. | 292/336.3 |
| 5,282,657 | 2/1994 | Clinch et al. | 292/336.3 |
| 5,318,333 | 6/1994 | Dreifert | 292/336.3 |
| 5,345,721 | 9/1994 | Stein et al. | 296/146.7 X |
| 5,377,450 | 1/1995 | Varajon | 49/502 |
| 5,403,047 | 4/1995 | Walls | 292/173 |
| 5,584,144 | 12/1996 | Hisano | 296/146.7 X |
| 5,603,548 | 2/1997 | Giandhi et al. | 296/146.7 |

*Primary Examiner*—Jerry Redman
*Attorney, Agent, or Firm*—Charles E. Leahy

[57] ABSTRACT

A vehicle door has a door trim panel to conceal a door inner panel. A rod is mounted on the inner panel and associated with the door latch to unlatch the door latch when the rod is pulled. A handle is pivotally mounted on the trim panel and has an arm projecting toward the inner panel. A plurality of door mounting hooks are provided on the lower edge portion of the trim panel for insertion into mating holes provided on the inner panel so that the trim panel is supported on the door in readiness and alignment for tilting of the trim panel into overlying relationship with the inner panel. A molded plastic guide track is mounted on the door inner panel, and a slider connected with the rod is slidably mounted on the guide track. The slider has an open-faced receptacle which opens toward the trim panel so that tilting of the trim panel into overlying relationship with the inner panel causes the arm of the handle to automatically seat within the receptacle and thereby achieve interconnection between the handle and slider. The open-faced receptacle is defined by angled walls which converge toward the bottom of the receptacle so that any misalignment between the arm of the handle and the slider will cause the arm to engage with the angled wall during the tilting movement of the door trim panel into overlying relationship with the door panel to thereby induce sliding movement and self-alignment of the slider with the handle. The guide track has integral snap tab features to attach the guide track to the door inner panel.

5 Claims, 3 Drawing Sheets

DOOR HANDLE TO LATCH ROD CONNECTION

TECHNICAL FIELD

This invention relates to an inside handle for a vehicle door and, more particularly, provides blind connection between a door handle mounted on the trim panel and a latch operating rod mounted on the door inner panel.

BACKGROUND OF THE INVENTION

It is well known that a motor vehicle door includes a sheet metal door inner panel which mounts a rod connected with the door latch so that pulling on the rod will unlatch the door latch. A conventional door also includes a door trim panel for mounting on the inside of the door inner panel to conceal the inner panel. The prior art has also suggested that the door trim panel carry mounting hooks on the lower edge thereof which fit into mating holes in the door inner panel to support the door trim panel on the door in readiness for tilting of the trim panel into overlying relationship with the inner panel.

It would be desirable to provide an improved vehicle door in which the door handle would be preassembled onto the door trim panel and, upon tilting of the trim panel onto the door inner panel, the handle would be reliably connected with the latch operating rod without any required manipulation by the assembly worker.

SUMMARY OF THE INVENTION

According to the invention, a vehicle door has a door trim panel to conceal a door inner panel. A rod is mounted on the inner panel and associated with the door latch to unlatch the door latch when the rod is pulled. A handle is pivotally mounted on the trim panel and has an arm projecting toward the inner panel. A plurality of door mounting hooks are provided on the lower edge portion of the trim panel for insertion into mating holes provided on the inner panel so that the trim panel is supported on the door in readiness and alignment for tilting of the trim panel into overlying relationship with the inner panel. A molded plastic guide track is mounted on the door inner panel, and a slider connected with the rod is slidably mounted on the guide track. The slider has an open-faced receptacle which opens toward the trim panel so that tilting of the trim panel into overlying relationship with the inner panel causes the arm of the handle to automatically seat within the receptacle and thereby achieve interconnection between the handle and slider. The open-faced receptacle is defined by angled walls which converge toward the bottom of the receptacle so that any misalignment between the arm of the handle and the slider will cause the arm to engage with the angled wall during the tilting movement of the door trim panel into overlying relationship with the door panel to thereby induce sliding movement and self-alignment of the slider with the handle. The guide track has integral snap tab features to attach the guide track to the door inner panel.

DESCRIPTION OF THE PREFERRED EMBODIMENT

Figure 1:
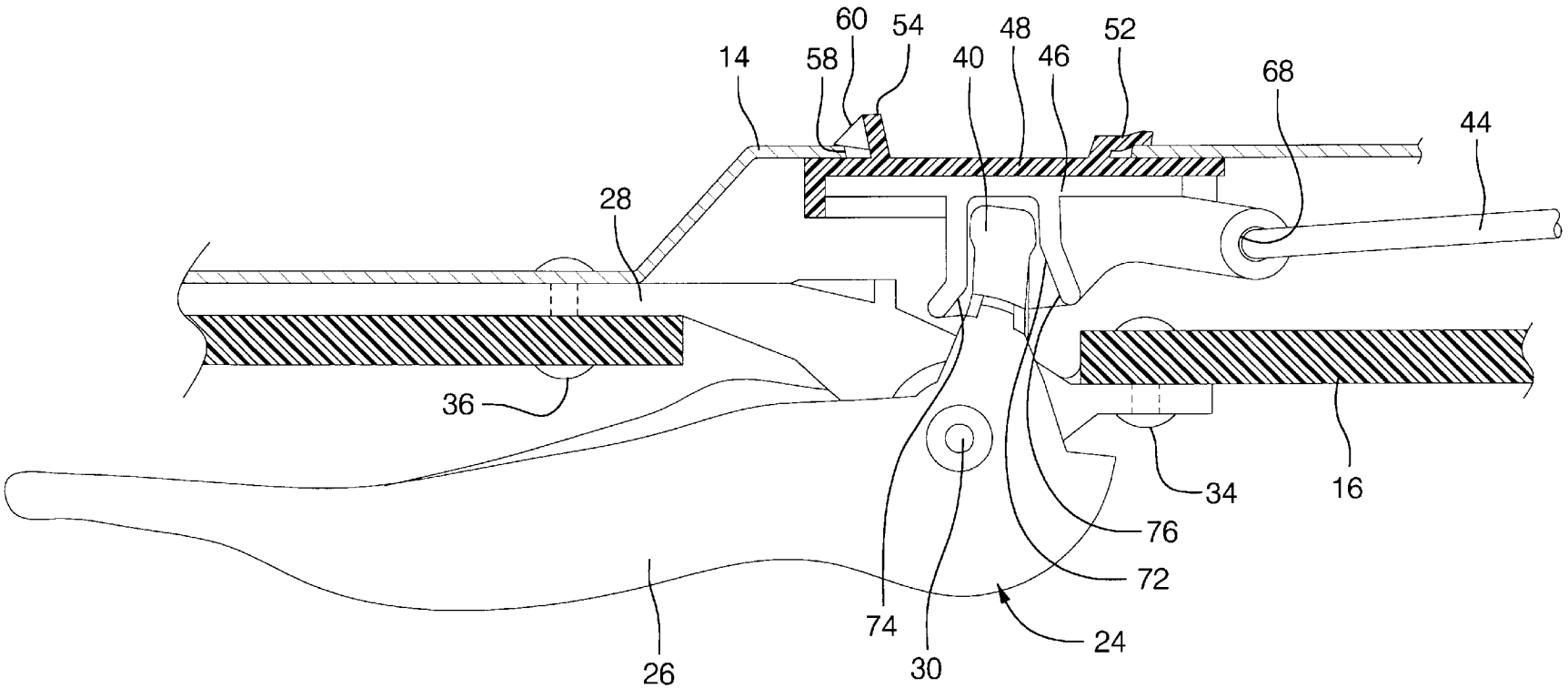
FIG. 1 is a section view taken through the inside door handle to show the connection between the door handle and a slider connected to the door latch operating rod.
Figure 2:
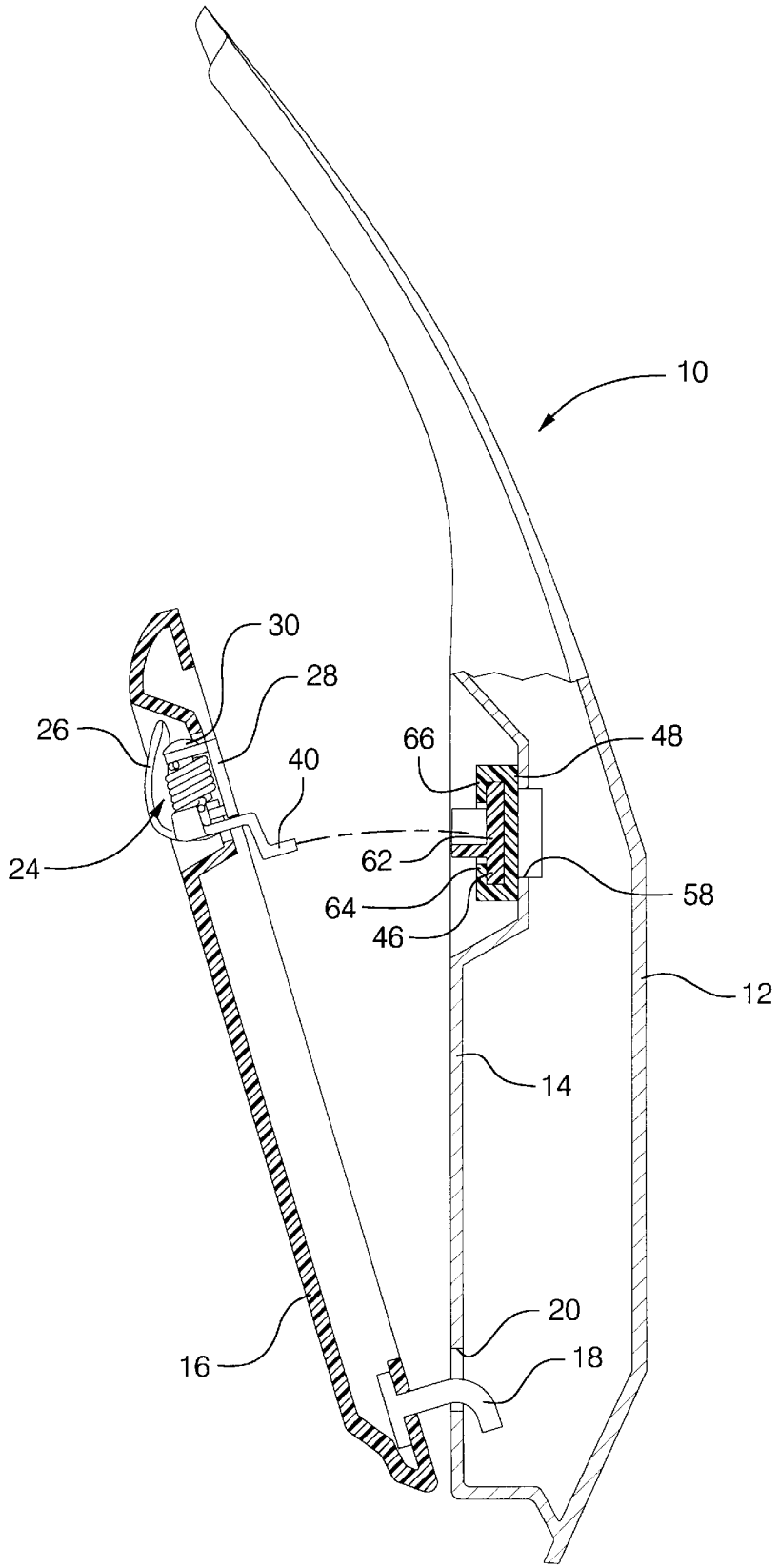
FIG. 2 is an elevation view of a vehicle door showing the door trim panel being installed onto the vehicle door.

Referring to FIGS. 1 and 2, a vehicle door generally indicated at 10 includes a stamped metal outer panel 12 and a stamped metal inner panel 14. A door trim panel 16 is provided for attachment onto the inside of the door, to overlie and conceal the door inner panel 14. As best seen in FIG. 2, the installation of the door trim panel 16 onto the door is facilitated by a plurality of hook members 18 which are carried on the lower edge of the trim panel 16 and are inserted into apertures 20 provided in the inner panel 14.

A door handle assembly generally indicated at 24 includes a handle 26 attached to a mounting bracket 28 by a pivot pin 30. The mounting bracket 28 is preassembled to the door inner panel 16 by rivets 34 and 36. Handle 26 includes an actuating arm 40 which reaches outwardly toward the door inner panel 14.

Figure 3A:
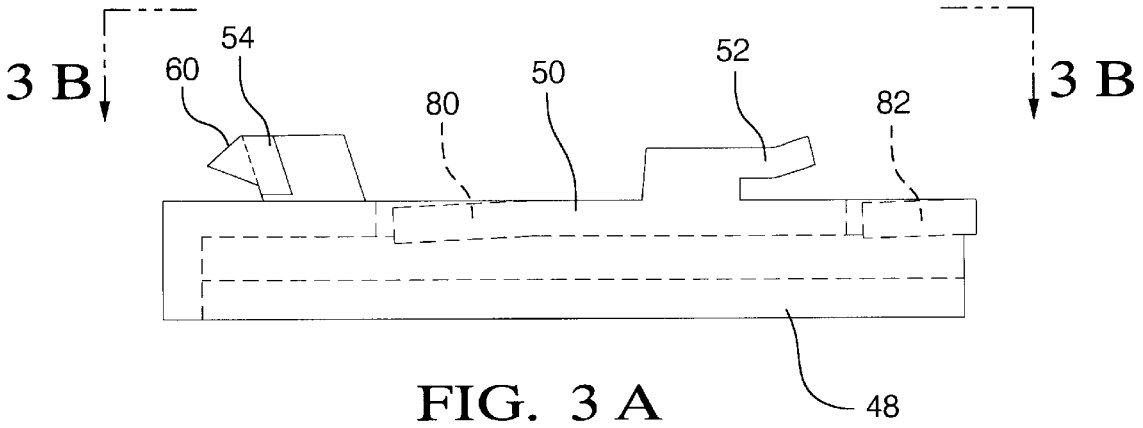
FIG. 3A is a top view of the guide track which is attached to the door inner panel.

As seen in FIG. 1, a door latch operating rod 44 is connected to the handle 24 by a molded plastic slider 46 which is slidably mounted on a guide track 48. As best seen in FIG. 3A, the guide track is of molded plastic construction and includes a base wall 50 having a mounting foot 52 projecting from the right end thereof and a flexible locking tab 54 projecting from the left end thereof. As best seen in FIG. 1, the guide track 48 is readily mounted within a rectangular opening 58 of the inner panel 14 by first feeding the anchoring foot 52 into the opening 58 and then pressing the flexible tab 54 into the opening so that an angled face 60 of the flexible tab 54 will engage with the inner panel 14 and cause flexible yielding of the tab 54 so that the tab 54 becomes engaged behind the inner trim panel 14.

As best seen in FIGS. 1 and 2, the slider 46 includes a base wall 50 which is slidably captured by inturned flanges 64 and 66 of the guide track 48 so that the slider 46 is mounted on the inner panel 14 and permitted to slide right and left as viewed in FIG. 1. The rod 44 is pivotally captured within an aperture 68 of the slider 46. As best seen in FIG. 1, the slider 46 has an open-faced receptacle 72 which opens toward the door trim panel 16 to receive the actuating arm 40 of door handle assembly 24. As seen in FIG. 1, the open-faced receptacle 72 is defined in part by opposed facing angled walls 74 and 76 which converge toward the bottom of the open-faced receptacle. Referring to FIG. 2, it will be seen and understood that the tilting movement of the door trim panel 16 into relationship with the door inner panel 14 will cause the actuating arm 40 of the door handle assembly 24 to become seated within the open-faced receptacle 72 of the slider 46. In addition, it is appreciated that should there be any misalignment between the handle 24 and the slider 46, the actuating arm 40 of the handle will engage with one of the angled walls 74 and 76 to urge a rightward or leftward sliding movement of the slider 46 to automatically align the slider 46 with the incoming actuating arm 40 of the handle assembly.

Figure 3B:
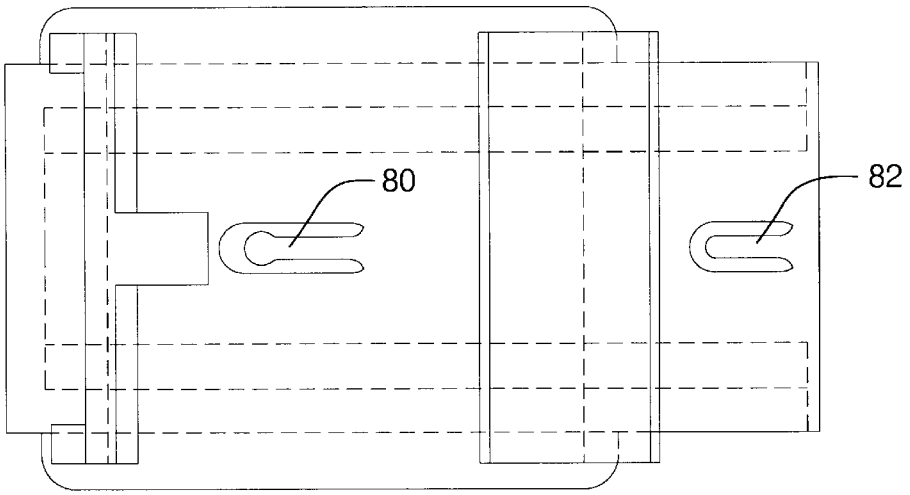
FIG. 3B is an elevation view of the guide track.

Referring to FIGS. 3A and 3B, it is seen that the base wall 50 of the guide track 48 has a pair of yieldable tabs 80 and 82 molded therein which yieldably bear on the slider to impose a friction force on the slider.

Thus, it is seen that the invention provides a new and improved door handle assembly for a vehicle door which will automatically engage a door handle assembly mounted on a trim panel with the latch operating rod upon installation of the door trim panel onto the vehicle door.

While this invention has been described in terms of some specific embodiments, it will be appreciated that other forms can readily be adapted by one skilled in the art. For example, the arm 40 can be provided on the slider, and the open-faced receptacle can be provided on the handle assembly. Accordingly, the scope of this invention is to be considered limited only by the following claims.

We claim:

1. In a vehicle door having a door trim panel to conceal a door inner panel having a rod mounted on the inner panel and associated with the door latch to unlatch the door latch when the rod is pulled, the improvement comprising:

a handle pivotally mounted on the trim panel;

a plurality of door mounting hooks carried by the trim panel for insertion in to mating holes provided in the door inner panel so that the lower portion of the door trim is supported on the door in readiness and alignment for tilting of the trim panel into overlying relationship with the inner panel to permit installation of fasteners securing the trim panel on the inner panel;

a guide track mounted on the door inner panel; and a slider connected to the rod and slidably mounted on the guide track, one of the slider and handle having an open-faced receptacle and the other of the slider and handle having an arm projecting toward the receptacle so that tilting of the trim panel into overlying relationship with the inner panel causes the arm of the handle to seat within the receptacle and thereby achieve an effective interconnection between the handle and the slider.

2. The vehicle door of claim 1 further comprising said open-faced receptacle having walls angled to converge toward the bottom of the receptacle so that misalignment between the arm of the handle and the slider will cause the arm to engage with the angled walls during the progressive tilting movement of the door trim panel into overlying relationship with the door inner panel to thereby induce sliding movement of the slider and mating interconnection between the handle and the slider irrespective of misalignment therebetween.

3. In a vehicle door having a door trim panel to conceal a door inner panel having a rod mounted on the inner panel and associated with the door latch to unlatch the door latch when the rod is pulled, the improvement comprising:

a handle pivotally mounted on the trim panel and having an arm projecting from the trim panel toward the inner panel;

a plurality of door mounting hooks carried by the trim panel for insertion in to mating holes provided in the door inner panel so that the lower portion of the door trim is supported on the door in readiness and alignment for tilting of the trim panel into overlying relationship with the inner panel to permit installation of fasteners securing the trim panel on the inner panel;

a guide track mounted on the door inner panel; and a slider connected to the rod and slidably mounted on the guide track, the slider having an open-faced receptacle opening toward the trim panel so that tilting of the trim panel into overlying relationship with the inner panel causes the arm of the handle to seat within the receptacle and thereby achieve an effective interconnection between the handle and the slider.

4. The vehicle door of claim 1 further comprising said slider having walls defining the open-faced receptacle and the walls being angled to converge toward the bottom of the receptacle so that misalignment between the arm of the handle and the slider will cause the arm to engage with the wall during the progressive tilting movement of the door trim panel into overlying relationship with the door inner panel to thereby induce sliding movement of the slider and mating interconnection between the handle and the slider irrespective of misalignment therebetween.

5. The vehicle door of claim 1 further comprising the door inner panel having an aperture therein and the guide track having an integral snap tab feature thereon by which the guide track is attached to the door inner panel.

* * * * *